United States Patent [19]

Kovacs

[11] Patent Number: 4,531,735

[45] Date of Patent: Jul. 30, 1985

[54] BOWLING DELIVERY REMINDER

[76] Inventor: Michael J. Kovacs, 491 Saginaw Ave., Claumet City, Ill. 60409

[21] Appl. No.: 133,351

[22] Filed: Apr. 29, 1980

[51] Int. Cl.[3] ..... A63B 69/00

[52] U.S. Cl. ..... 273/54 B; 128/87 A

[58] Field of Search ..... 273/54 B; 128/87 A

[56] References Cited

U.S. PATENT DOCUMENTS

| | | | |
|---|---|---|---|
| 1,617,942 | 2/1927 | Foulke | 128/87 A |
| 1,837,691 | 12/1931 | Thigpen | 128/87 A |
| 3,235,258 | 2/1966 | Stroburg | 273/54 B |
| 3,606,342 | 9/1971 | Albertson | 273/54 B |
| 4,194,736 | 3/1980 | Loafman | 273/54 B |

OTHER PUBLICATIONS

"Super Touch" TM, Bowling Magazine, Mar. 1980, p. 9.

DePuy Catalog, vol. 16, publ. 1937, p. 28.

*Primary Examiner*—Anton O. Oechsle

*Attorney, Agent, or Firm*—Chas. W. Rummler

[57] ABSTRACT

A device for application to the top of the index finger to remind the bowler of the proper position of the hand when delivering a bowling ball on the lane of a bowling alley.

4 Claims, 8 Drawing Figures

BOWLING DELIVERY REMINDER

BACKGROUND OF THE INVENTION

In bowling, it is very difficult, even for professional bowlers, to deliver the ball on the lane correctly each time it is to be delivered. The reason, normally, is that the hand of the bowler holding the ball is not correctly positioned on the moment of release of the ball onto the lane.

It was to help the bowler and remind him of such proper hand positioning at the time of delivery of the ball onto the lane that the present invention was conceived.

SUMMARY OF THE INVENTION

A device removably secured to the index finger, with a forward narrow elongated portion to be positioned on a portion of the top of the index finger and an integrally formed rearward angular portion having a flat bottom side for positioning on the back of the hand with an area at the juncture of the forward and rearward portions covering the index finger knuckle at the back of the hand.

DETAILED DESCRIPTION OF THE DRAWINGS

The device of the present invention is preferably made of a rigid plastic and comprises elongated portion 10 having an arcuately shaped cross-section that is designed to lie on the top of the index finger and fit the upper side thereof.

Figure 1:
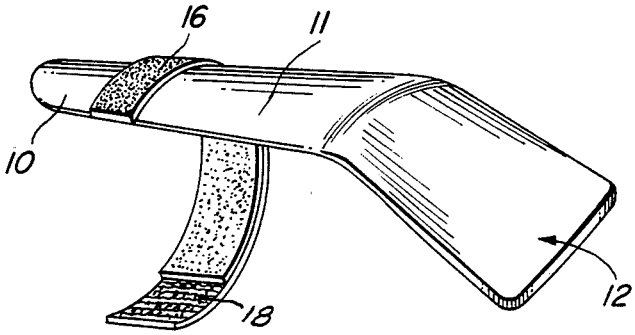
FIG. 1 is a perspective view of the present invention.
Figure 3:
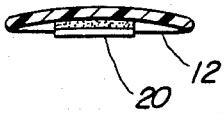
FIG. 3 is a cross-sectional view taken on the lines 3—3 of FIG. 2.
Figure 4:
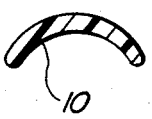
FIG. 4 is a cross-sectional view taken on the lines 4—4 of FIG. 2.
Figure 2:
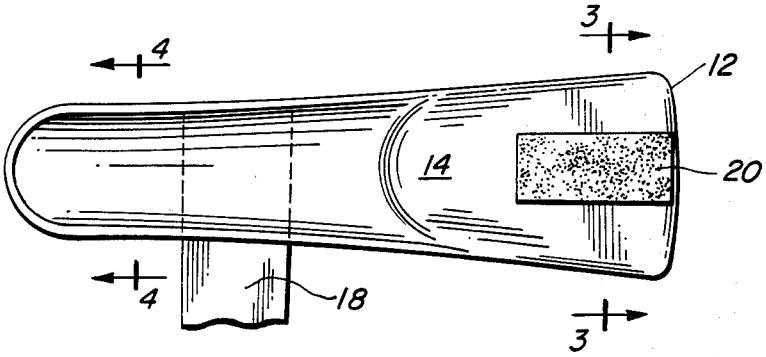
FIG. 2 is a bottom side view of the same.
Figure 5:
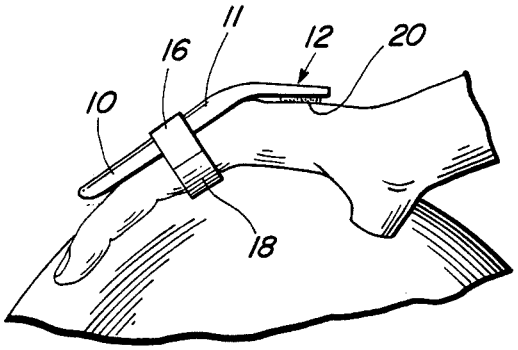
FIG. 5 is a side elevational view of the device attached to the index finger of the hand and showing a portion of a bowling ball.

Integrally formed on the rear portion 12 is a flat area which extends at about a 140° angle from the axis of the elongated portion 10 to seat on the index finger knuckle at the back of the hand and overlie the back of the hand to bear thereagainst. The knuckle of the index finger at the back of the hand seats in the portion 14 shown in FIG. 2. A strip 16 of Velcro looped material is secured to the upper side 11 of the elongated portion 10, as shown in the drawings, and a longer strip of Velcro hooked material 18 is secured thereto whereby the strip 18 may be wrapped securely around the rearward portion or proximal phalanx of the index finger as indicated by FIG. 5.

The bottom side of the flat area of the rear end portion 12 is provided with a soft resilient pad 20 to prevent the end of the rear portion 12 from digging into the skin when the unit is in place and in use on a bowler's hand.

Figure 6:
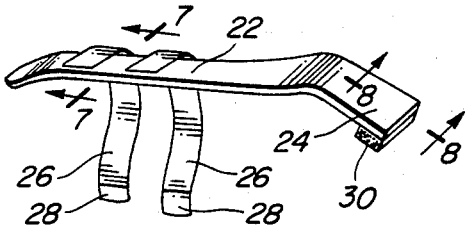
FIG. 6 is a perspective view of a modified form of the invention.
Figure 7:
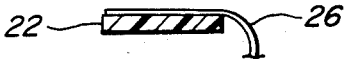
FIG. 7 is a cross-sectional view taken on the lines 7—7 of FIG. 6, a portion of the securing tape being broken away.
Figure 8:
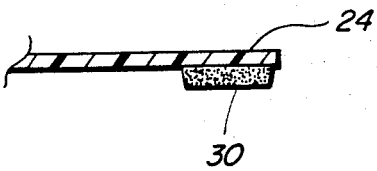
FIG. 8 is a fragmentary cross-sectional view as taken on the lines 8—8 of FIG. 6.

A modified construction is shown in FIGS. 6, 7 and 8 wherein the forward portion 22 is flat and lays on the top of the index finger of the bowler's hand and the rearward portion 24 is also flat and integral with the forward portion but bent at an angle of about 140°. The portion 24 lies against the rear of the hand and over the knuckle of the index finger at the back of the hand and the under side of the portion 24 is provided with a resilient pad 30.

A pair of spaced elongated straps or tapes 26 are anchored by one end to the upper surface of the forward portion 22. The opposed ends of these straps are provided with a tacky substance 28 which will adhere to the upper surface of the straps when the straps are wrapped around the index finger to retain the unit on the finger.

In bowling, no matter how the bowler holds the ball with both hands at the beginning of the approach, his thumb, ring finger and middle finger are generally seated up to the middle knuckle in the holes already properly drilled in the bowling ball. Some bowlers hold the ball in front of their chest, others to the side of their chest, while still others may hold the ball adjacent their hip. As the bowler begins his approach to the foul line, the ball is carried by the right hand of a right handed bowler, or the left hand of a left handed bowler, and as he nears the foul line, the bowler turns his wrist and hand carrying the ball and then delivers it to the bowling lanes just over the foul line. Since the movement of the legs and feet from the starting position and the movement of the arm, hand and wrist must be synchronized, it is normally not possible to deliver the ball to the lanes in the correct manner each time the ball is delivered. However, by applying the device of the present invention to the index finger, the knuckle and the back of the hand, as shown in FIG. 5 of the drawings, the bowler, upon seeing the device on the index finger as the ball crosses the foul line, immediately knows this is the correct time to release the bowling ball and be consistent in delivering the ball to the lanes.

The angled rear portion of the herein described bowling ball delivery reminder is a very important feature in purpose of preventing breaking of the wrist near the end of the backswing, which could not only spoil timing but also seriously injure the bowler's wrist. This often happens to amateur bowlers and sometimes to very experienced bowlers because of the relatively heavy weight of the ball which has considerable inertia at the end of the backswing which requires careful attention to control. The angled rear portion of the device of the present invention acts as a positive reminder to keep firm control of backswing action.

It is to be understood that details of the construction of this invention as shown may be altered or omitted without departing from the spirit of the invention as defined by the following claims.

I claim:

1. A device removably secured to the index finger of a bowler's hand, comprising an elongated portion to seat on the upper side of the index finger, an integrally formed flat member extending angularly from the rearward end of the elongated portion to overlie and bear against the back of the hand forward of the wrist when holding a bowling ball, and strap means on said elongated portion for encircling the proximal phalanx only of the finger to secure said portion to the upper surface of the index finger.

2. The device according to claim 1 wherein the flat member extends at an angle of about 140 degrees.

3. The device according to claim 1 wherein the said flat member is wider than the elongated member.

4. A device for wearing on the finger and hand of a bowler to enhance bowling proficiency comprising:

a rigid element formed in an obtuse angle with first and second elongated portions extending from the apex of said angle;

said first and second portions being adapted to overlie and bear against the back of the index finger and the back of the hand when the finger is bent at an angle corresponding to said obtuse angle;

and securing means for securing said device to the hand and finger consisting of means for attaching only said first elongated portion to the back side of the index finger, said attaching means allowing bending of the finger toward the palm while constraining backward bending thereof to a bent position approximating said obtuse angle.

* * * * *